US005454757A

United States Patent [19]

Wirfel

[11] Patent Number: 5,454,757

[45] Date of Patent: Oct. 3, 1995

[54] INTERCHANGEABLE GEARS FOR DAMPER ASSEMBLIES

[75] Inventor: Kevin L. Wirfel, Versailles, Ky.

[73] Assignee: Johnson Service Company, Milwaukee, Wis.

[21] Appl. No.: 328,292

[22] Filed: Oct. 24, 1994

[51] Int. Cl.[6] ..... F24F 13/15

[52] U.S. Cl. ..... 454/336; 454/335; 137/601

[58] Field of Search ..... 137/601; 454/273, 454/278, 281, 319, 325, 326, 335, 336

[56] References Cited

U.S. PATENT DOCUMENTS 3,447,443 6/1969 Silvey ..... 454/336 X
4,275,762 6/1981 Field ..... 454/335 X

*Primary Examiner*—Harold Joyce
*Attorney, Agent, or Firm*—Joseph E. Root, III; Leonard J. Kalinowski; E. L. Levine

[57] ABSTRACT

A damper assembly gear system for interchangeably carrying either airfoil damper blades or single-ply damper blades. A first embodiment, in which the damper blades rotate in opposition to one another, includes a group of gear bodies, each of which includes a tab structure, including both airfoil tabs and single-ply tabs, for mounting both types of damper blades. The airfoil tabs are shaped to match an airfoil damper and are spaced apart such that an airfoil damper can be inserted between and gripped by the airfoil tabs. Single-ply tabs are located between the airfoil tabs, shaped to match a single-ply damper and spaced apart such that a single-ply damper can be inserted between the single-ply tabs and gripped thereby. An alternative embodiment allows the system to be used in conjunction with both opposed and parallel damper assemblies. First, this embodiment includes two types of gears, blade gears and idler gears. Blade gears of identical in form and function to those discussed above, except that they include a gear shroud extending from the face of said gear body radially outward to cover said teeth. Idler gears lack the blade mounting structure and are disposed between blade gears and transmit rotational forces such that blade gears rotate in the same direction. Also, the idler gear teeth are offset in thickness by a distance equal to the thickness of the shroud, so that the shroud effectively retains the idler gear in position.

2 Claims, 2 Drawing Sheets

INTERCHANGEABLE GEARS FOR DAMPER ASSEMBLIES

BACKGROUND OF THE INVENTION

The present invention is generally related to the field of air ventilation control devices and more specifically to the field of damper arrays for controlling airflow within a duct system.

Damper assemblies are the standard method for regulating airflow within a building's ductwork. Actuated either pneumatically or electrically, an array of damper blades is usually mounted in a frame that itself is either mounted in a duct or is part of the duct itself. Damper assemblies can be classified by both the way in which the blades rotate relative to each other and by the shape of the blades themselves. In the first instance, blades can be arranged to rotate either in opposition to one another (that is, one blade rotates clockwise while adjacent blades rotate counterclockwise) or in parallel (with adjacent blades rotating in the same direction). Choosing between these methods is generally based on the nature of the application and on design preference. Also, damper blades can be formed from a single ply of metal (which is inexpensive) or shaped as an airfoil (which imposes minimum drag but costs more). The choices here generally trade off performance and price.

These choices, however, are difficult to implement because manufacturers uniformly require that these options must be built into the product at the time of fabrication. Clearly, this requirement imposes inordinate inventory requirements on dealers and slows down deliveries. Also, consumers cannot change a unit after it is installed. If a user decides after installing a single-ply damper that it is willing to pay for the improved performance of airfoil blades, it must order a completely new unit.

To date, the prior art has failed to offer a unit that can offer flexibility at low cost. That failure is cured by the present invention.

SUMMARY OF THE INVENTION

The broad object of this invention is to provide a gear system for use in a damper assembly, designed to permit the interchangeable use of airfoil or single-ply damper blades.

A further object of the invention is to provide a gear system for use in a damper assembly, designed to allow users to select either opposed or parallel blade arrangements in the field.

These and other objects are achieved in the present invention, a gear system for carrying either airfoil damper blades or single-ply damper blades within a damper assembly. A first embodiment, in which the damper blades rotate in opposition to one another, includes a group of gear bodies, each generally circular in form and having circumferential teeth and carried on the damper assembly in an array so that the teeth mesh. Each gear body includes a structure for mounting both types of damper blades. This structure includes both airfoil tabs and single-ply tabs, both upstanding on a face of the gear body. The airfoil tabs are shaped to match an airfoil damper and spaced apart such that an airfoil damper can be inserted between and gripped by the airfoil tabs, positioned such that an airfoil damper inserted between the airfoil tabs is thus centered on the gear body Single-ply tabs are located between the airfoil tabs, shaped to match a single-ply damper and spaced apart such that a single-ply damper can be inserted between the single-ply tabs and gripped thereby, the damper blade being thus centered on the gear body.

An alternative embodiment of the invention adds two features which allow the system to be used in conjunction with damper assemblies in which the damper blades rotate in the same direction, known as parallel damper assemblies. First, this embodiment includes two types of gears, blade gears and idler gears. Blade gears are identical in form and function to those discussed above, except that they include a gear shroud extending from the face of the gear body radially outward to cover the teeth. Idler gears lack the blade mounting structure and are disposed between blade gears to transmit rotational forces such that blade gears rotate in the same direction. Also, the idler gear teeth are offset in thickness by a distance equal to the thickness of the shroud, so that the shroud effectively retains the idler gear in position.

DETAILED DESCRIPTION OF PREFERRED EMBODIMENTS

Figure 1:
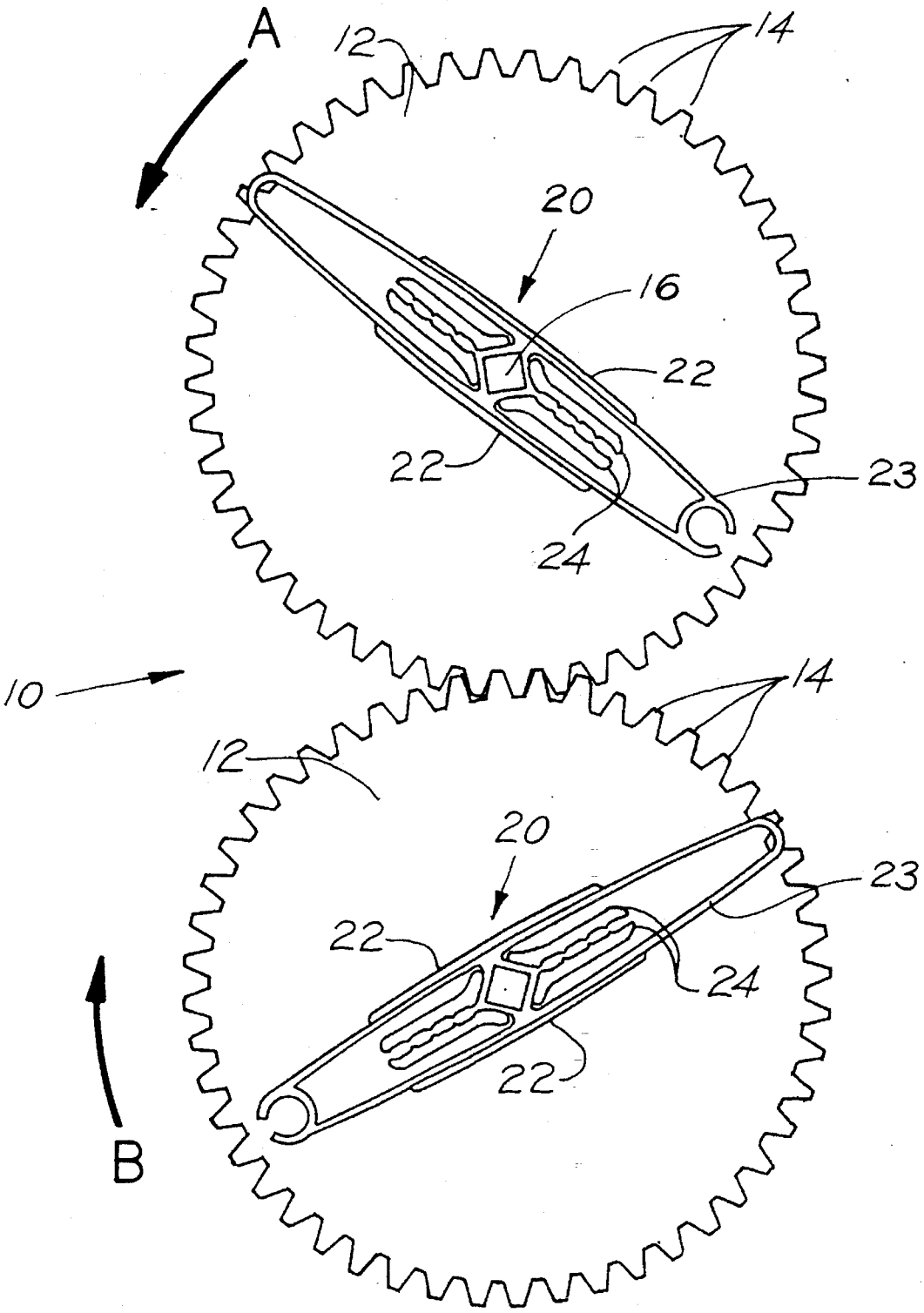
FIG. 1 is a plan view of an embodiment of the present invention.

A gear system 10 according to the present invention is seen in FIG. 1. As seen there, the system includes a number of individual gears 12, each of which is made up of a gear body 12, with teeth 14 arranged circumferentially, and an axle aperture 16 at its center. This portion of the structure is entirely conventional and is thus known to those in the art. It is preferred that the gear body be injection molded from a thermoplastic resin material that combines high strength with light weight, such as nylon or delrin, as used in similar applications. In a preferred embodiment, each gear body is about 6 inches in diameter, matching the damper blade width, but that dimension can be selected by those in the art.

The blade carrying assembly 20 is centrally located on the gear body, and it includes airfoil carrier tabs 22 and single carrier tabs 24. Each tab set consists of an opposed pair of upstanding tabs that project upward about 0.5 inch from the gear body surface. Each tab set is shaped to accept and grip a selected damper blade. Thus the airfoil tabs 22 are spaced apart by about the central thickness of an airfoil damper blade 23, preferably about 0.75 inch, and the distance between the tabs is varied to match the airfoil shape of the blade. Similarly, the single-ply tabs are spaced apart by the relatively narrow distance equal to the thickness of a single-ply damper blade 25 (shown in FIG. 2), or about 0.125 inch. The illustrated design reflects the fact that the preferred single-ply damper blade has a cut-out in each end to accommodate the axle aperture 16, but that feature can be varied to suit individual damper blade designs.

It can be seen that the gear bodies 12 of FIG. 1 are dimensioned with their diameters approximately equal to the length of the damper blades, which is preferably about six inches. Given that the gear teeth are enmeshed, it can also be seen that the damper blades act in opposition; that is, when the rotation of a first gear (such as the upper gear of FIG. 1) rotates in a given direction (such as the direction of arrow A), the adjacent gear rotates in the opposite direction (such as the direction of arrow B). In that manner, the damper blades also rotate in opposite directions, either toward one another to close or away from each other to open.

Figure 2:
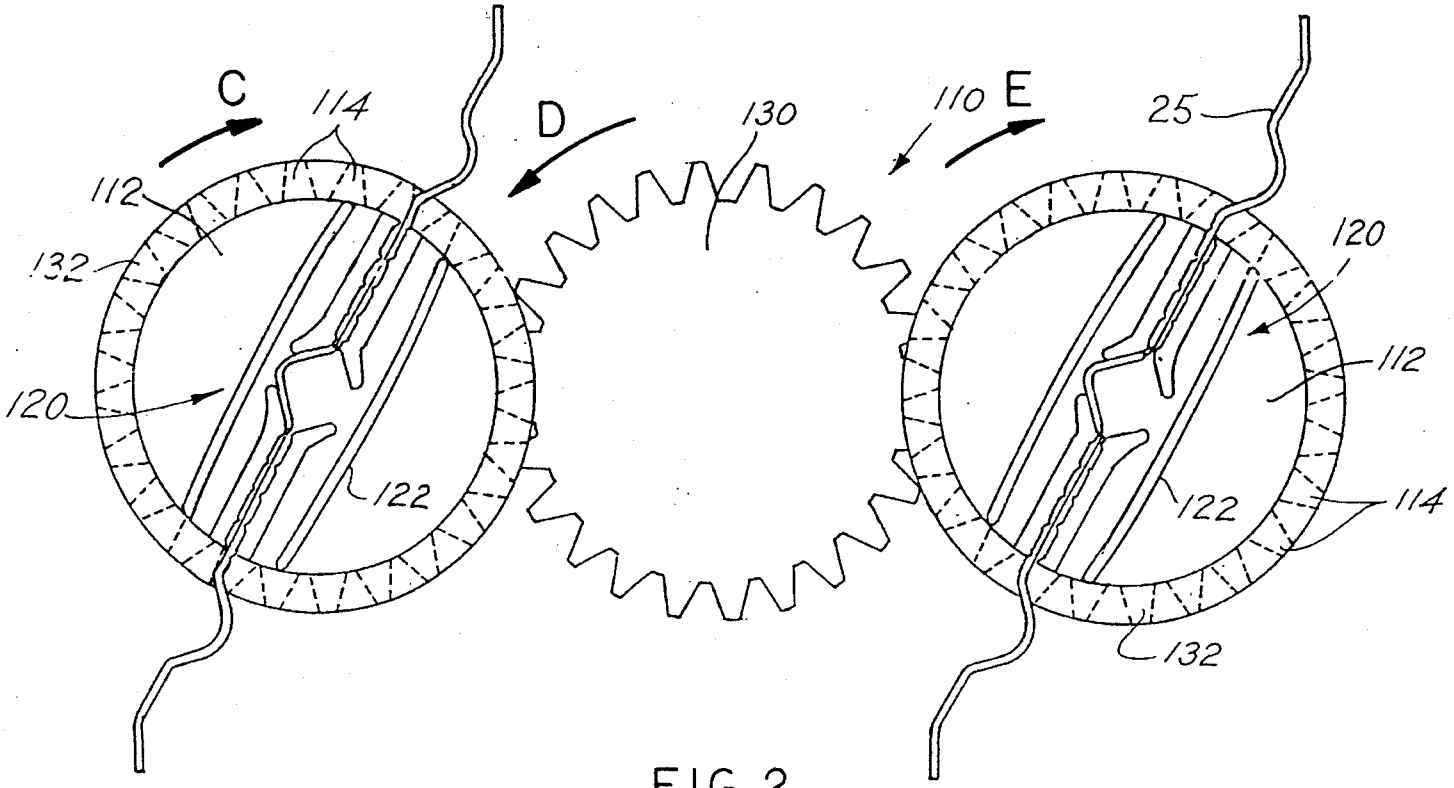
FIG. 2 is a plan view of an alternative embodiment of the present invention.

The present invention also permits a parallel arrangement, in which damper blades rotate in the same direction, as shown in the parallel gear system 110 depicted in FIG. 2. There, parallel gear bodies 112 are sized so that their diameters are about half the width of a damper blade, or preferably about three inches. The blade carrying assembly 120 on each gear body, however, is identical to that carried on gear body 12. On gear body 12, assembly extends only across only about half the diameter of the gear body, while here it covers approximately the entire diameter. This sizing insures that the damper blades are gripped and manipulated in the same manner, regardless which gear system is being used.

The primary difference between the two arrangements lies in the inclusion of an idler gear 130, identical in size to the gear bodies 112 and positioned between and enmeshed with two parallel gear bodies. The idler gear allows parallel gears to rotate in the same direction. When a parallel gear (such as the leftmost gear in FIG. 2) rotates in a given direction (such as the direction of arrow C), the idler gear rotates in the opposite direction (such as the direction of arrow D), and in turn this drives the next parallel gear (such as the rightmost gear in FIG. 2) in the same direction as the first gear (such as the direction of arrow E, which is the same direction as arrow C). Thus, the damper blades rotate in the same direction.

Figure 3:
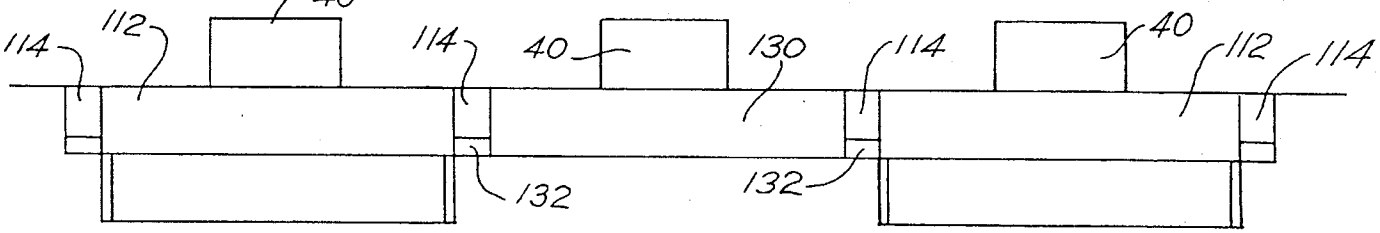
FIG. 3 is a top view of the embodiment shown in FIG. 2.

A second difference in this embodiment is that gear teeth 114 do not extend across the entire thickness of the parallel gear body, as show in FIG. 3. This permits the inclusion of shroud 132 on gear bodies 112, lying above and covering the gear teeth 114. When the idler gear is enmeshed with parallel gear bodies, the shroud prevents the idler gear from migrating out of position and falling out of registration with the damper frame, which would require the attention of maintenance personnel.

In either embodiment, two gear bodies carry each damper blade, so that the number of gear bodies required to make up a given system depends on the number of damper blades to be employed in the completed damper assembly. The illustrated gear systems, using two gear bodies at each end of the damper assembly, would be used in a two-blade damper system. A four-blade system would require four gears, and so on. Typically the completed damper assembly will be carried within a damper frame (not shown), and it is conventional to mount the gears directly to the frame, such as by providing circular bosses 40 (shown in FIG. 3) on the back side of the gear body, fitted into apertures on the damper frame. Identical bosses are formed on the gear body 12, the parallel gear body 112 and the idler gear 130.

Those in the art will appreciate that alterations and modifications of the depicted embodiments are possible without departing from the spirit of the invention. For example, the shape of the damper blades in a given system will to some extent determine the exact shape and dimensions of the blade carrying assembly, or the materials might be chosen to reflect specific application requirements. These and other changes fall within the scope of the invention, which is defined solely by the claims appended hereto.

I claim:

1. A gear system for carrying either airfoil damper blades or single-ply damper blades within a damper assembly, comprising:

a plurality of gear bodies, each being generally circular in form and having circumferetial teeth formed thereon, carried on the damper assembly in an array wherein said teeth mesh, each gear body having a blade carrying assembly, including means for carrying airfoil damper blades, including airfoil tabs upstanding on a face of said gear body, shaped to match an airfoil damper and spaced apart such that an airfoil damper can be inserted between said airfoil tabs and gripped thereby, said airfoil tabs being positioned such that an airfoil damper inserted between said airfoil tabs is thereby centered on said gear body;

means for carrying single-ply damper blades, including single-ply tabs upstanding on a face of said gear body between said airfoil tabs, shaped to match a single-ply damper and spaced apart such that a single-ply damper can be inserted between said single-ply tabs and gripped thereby, said single-ply tabs being positioned such that a single-ply damper inserted between said single-ply tabs is thereby centered on said gear body.

2. A gear system for carrying either airfoil damper blades or single-ply damper blades in a damper assembly, comprising:

a plurality of gear bodies, each being generally circular in form and having circumferetial teeth formed thereon, carried on the damper assembly in an array wherein said teeth mesh, including blade gears, each having a blade carrying assembly, including means for carrying airfoil damper blades, including airfoil tabs upstanding on a face of said gear body, shaped to match an airfoil damper and spaced apart such that an airfoil damper can be inserted between said airfoil tabs and gripped thereby, said airfoil tabs being positioned such that an airfoil damper inserted between said airfoil tabs is thereby centered on said gear body;

means for carrying single-ply damper blades, including single-ply tabs upstanding on a face of said gear body between said airfoil tabs, shaped to match a single-ply damper and spaced apart such that a single-ply damper can be inserted between said single-ply tabs and gripped thereby, said single-ply tabs being positioned such that a single-ply damper inserted between said single-ply tabs is thereby centered on said gear body;

a gear shroud extending from the face of said gear body radially outward to cover said teeth;

idler gears, the teeth thereof being offset from the gear face by a thickness sufficient to allow said idler gear teeth to mesh with said teeth on a said blade gear; and wherein said idler gears alternate between said blade gears.

* * * * *